US006425615B1

(12) United States Patent
Mullane, Jr.

(10) Patent No.: US 6,425,615 B1
(45) Date of Patent: Jul. 30, 2002

(54) OVERSHOT TOOL

(75) Inventor: George W. Mullane, Jr., Humble, TX (US)

(73) Assignee: Logan Oil Tool, Inc., Houston, TX (US)

( * ) Notice: Subject to any disclaimer, the term of this patent is extended or adjusted under 35 U.S.C. 154(b) by 0 days.

(21) Appl. No.: 09/506,961

(22) Filed: Feb. 18, 2000

(51) Int. Cl.[7] ..... E21B 31/18
(52) U.S. Cl. ..... 294/86.3; 294/86.17
(58) Field of Search ..... 294/86.1, 86.26, 294/86.3, 86.34, 86.17; 166/98, 99

(56) References Cited

U.S. PATENT DOCUMENTS 2,394,832 A * 2/1946 Young ..... 294/86.3
2,492,813 A * 12/1949 Osmun ..... 294/86.3
2,616,752 A * 11/1952 Osmun ..... 294/86.3
2,955,868 A * 10/1960 Horn, Jr. ..... 294/86.3
4,023,847 A * 5/1977 Webb ..... 294/86.3
4,369,977 A * 1/1983 Bishop et al. ..... 166/99

* cited by examiner

*Primary Examiner*—Dean J. Kramer
(74) *Attorney, Agent, or Firm*—Browning Bushman P.C.

(57) ABSTRACT

There are disclosed two embodiments of an overshot tool for use in recovering a fish within a well bore, wherein a radially expandable and contractible grapple having helical tapered outer surfaces is seated upon a bowl within an intermediate portion of a tubular body on which the tool is lowered over the upper end of the fish, thus enabling the grapple to be lowered about the upper end of the fish and the teeth about its inner diameter to bite into the fish. A control assembly packer having a metal body mounted beneath the grapple has tangs for extending into slots in the body and grapple to limit the rotation between them, and the packer assembly carries a seal ring for sealably engaging the fish, which is held in place by means of a retainer ring threaded to the metal body of the assembly supported within the bore of the body.

12 Claims, 3 Drawing Sheets

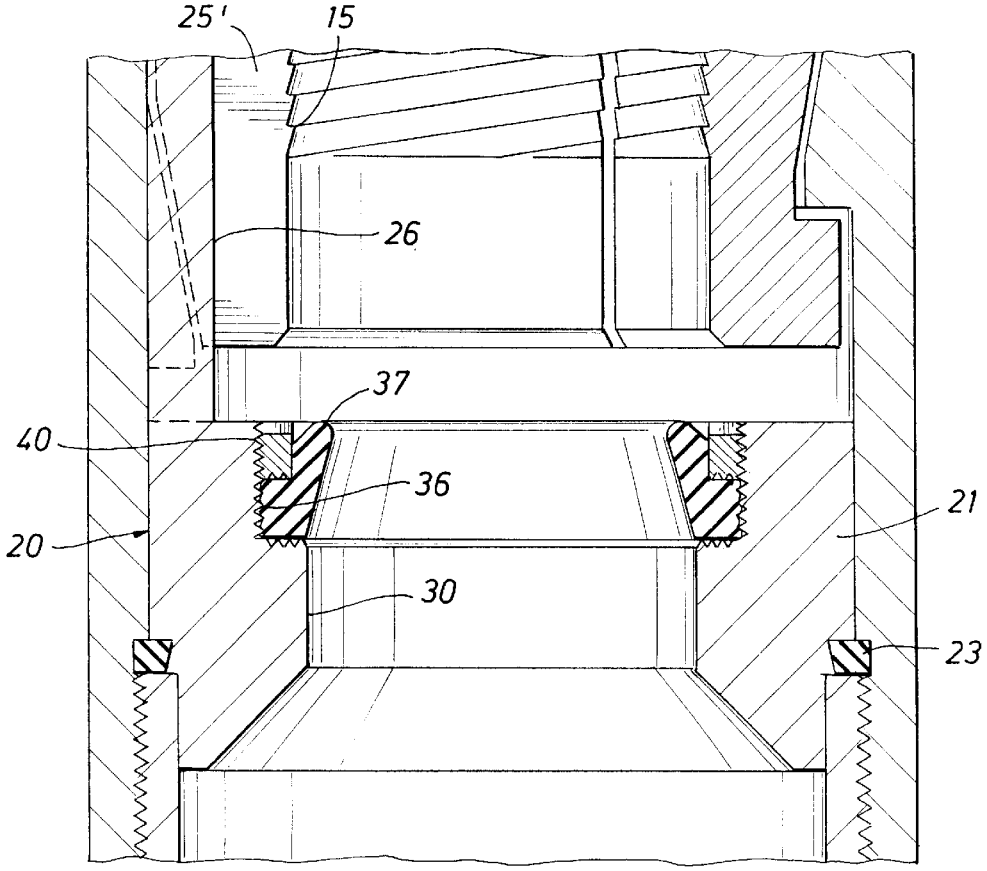
FIG. 2
FIG. 3
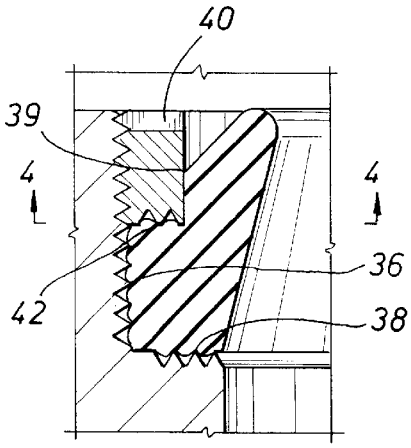
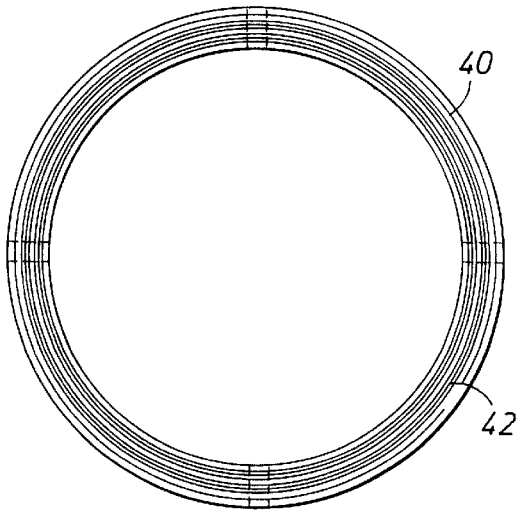
FIG. 4

OVERSHOT TOOL

This invention relates in general to an overshot tool of the type having a radially expandable and contractible grapple lowerable on a pipe string about a fish stuck within a well bore to enable it to be retrieved therewith. More particularly, it relates to improvements in a tool of this type which facilitates retrieval of the fish by enabling fluid to be circulated through the pipe string and fish and then upwardly about the annulus between the string and well bore to loosen debris in which the fish is stuck, or, in the event the fish cannot be retrieved, to permit the tool to be released from the fish for recovery from the well bore.

As well known in the art, a fish is a length of pipe which, during drilling of the well bore, has become inadvertently stuck and left with the well bore as a section of the pipe above has separated therefrom. The fish must of course be retrieved or otherwise removed from the well bore in order to permit the drilling to proceed, in the event it cannot be retrieved, the tool must be removed from the well bore to permit the fish to be drilled out or otherwise removed.

For this purpose, the overshot tool of the type to which this invention relates includes a tubular body whose upper end is adapted to be connected to a pipe string for vertical movement within the well bore, a lower end which is adapted to fit over the fish when so lowered, a bowl within the body bore having helically tapered surfaces, and a seat beneath the bowl. A radially expandable and contractible grapple supported within the bowl has helically tapered outer surfaces adapted to slidably engage those of the bowl and, vertically spaced helical threads or wickers about its inner side adapted to engage the fish. More particularly, the bowl and body have aligned slots, and a packer supported on the seat has a tang for fitting within aligned slots in the body and grapple so as to limit rotation between them, whereby as the tool body is raised and rotated to the right, the grapple surfaces slide downwardly along the bowl surfaces to cause the threads to tightly grip the fish so that it may be retrieved upon lifting of the pipe string or, in the event the fish cannot be retrieved, the tool body may be jarred downwardly to release the grip of the grapple threads and thus permit the tool to be retrieved.

In accordance with one such tool, the packer assembly includes a metal body supported on the seat and having an annular groove about its bore which receives a ring of elastomeric material having a lip about its bore to engage about the fish. One problem with prior tools of this type is a tendency of the packer seal to fail or be blown out thus allowing circulating fluid to pass between the fish and inside of the tool instead of into the fish to loosen it from the debris. Thus, although some have included a seal ring including a lip intended to seal about the upper end of the fish, they tend to fail, especially in response to the high hydrostatic load of the circulating fluid above them.

For this purpose, it has been proposed to mold the seal ring into a recess within the bore of the metal body. Nevertheless, the seal often fails or is blownout so that the tool must be retrieved to permit replacement of the seal ring or replacement of the entire packer assembly if molding facilitates one not convenient. In any case, retrieval and rerunning of the tool entails considerable down time at a great expense to the operator.

An object of this invention is to provide an overshot tool of this type having a packer of such construction as to minimize these problems, in that the seal thereof is more securely carried by the packer assembly body.

Another object is to provide such a tool having alternate embodiments of the control packer especially well suited for use in recovering fish of different diameters.

These and other objects are accomplished in accordance with the novel aspects of the present invention, by a tool of the type described in which the packer assembly includes a metal body adapted to be supported on the seat and has a counterbore about the upper end of its bore and threads about the counterbore, and a ring of elastomeric materials adapted to fit closely within the counterbore of the packer body, a lip about its bore to sealably engage about the fish, and an annular recess about the upper end of its outer diameter to provide a seat on its lower end. The packer further includes a metal ring within the recess having threads thereabout adapted to be made up with the threads on the metal body to hold the elastomeric ring downwardly against the seat on the lower end of the recess.

In one embodiment of the invention, wherein the tool is adapted to fit over a relatively small diameter fish, the metal ring has an upper end adapted to terminate beneath the upper end of the metal body when made up with the metal body, and the tang is on the metal body. In another embodiment, wherein the tool is adapted to fit over a relatively large diameter fish, the metal ring has an outwardly extending flange on its upper end adapted to overhand and engage the upper end of the metal body when the metal ring is made up with the metal body, and the tang is on the metal ring. In each embodiment, the seat of the metal body has concentric ribs for biting into the lower end of the seal ring, and the metal ring has concentric ribs on its lower end for biting into the seat of the recess of the seal ring, thus more securely holding the seal ring in place.

In the drawings, wherein like paragraphs are used throughout to designate like parts:

FIG. 2 is an enlarged cross-sectional view of the lower portion of the tool, including the packer assembly constructed in accordance with a first embodiment supported in the tubular body beneath the grapple:

FIG. 3 is a further enlarged vertical sectional view of the seal ring and retainer ring for holding the seal ring of FIG. 2 within a counterbore of the packer assembly in the metal body of the packer assembly;

FIG. 4 is a view of the lower end of the retainer ring, as seen on broken lines 4—4 of FIG. 3;

Figure 1A:
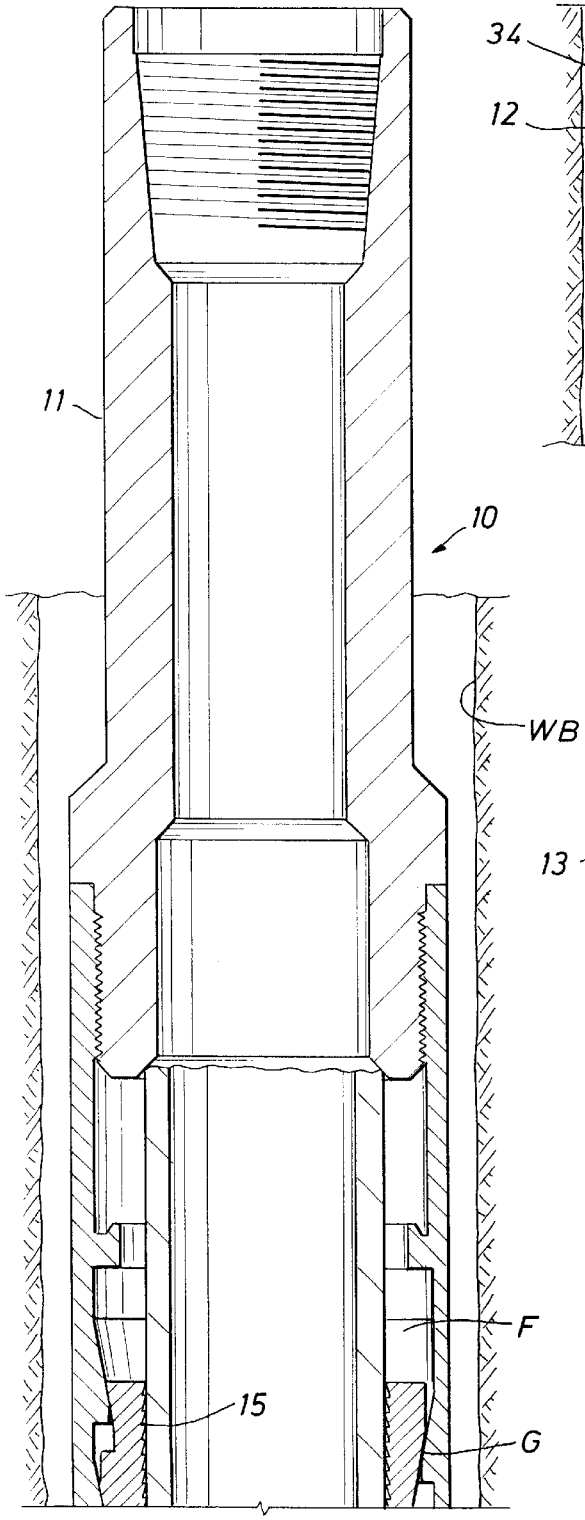
FIGS. 1A and 1B are vertical sectional views of upper and lower portions, respectively, of an overshot tool constructed in accordance with the present invention, and shown with its grapple lowered over and gripping a fish stuck within a well bore.

With reference now to the details of the above described drawings, the overshot tool, which is indicated in its entirety by reference character 10, is shown in FIGS. 1 and 2 disposed over and about a fish Fstuck within a well bore WB. As shown, the fish is the lower end of a pipe which has been broken off from a length of the pipe thereabove, and stuck within debris within the well bore. Alternatively, it could be a pipe section unthreaded from an upper length of pipe. In any case, the fish normally has a smooth outer exterior so that it cannot be reached by a grapple beneath a collar or the like.

The tool 10 is made up of a top-sub 11 having an upper end adapted to be suspended from a well string lowered into the well bore, an intermediate tubular member forming a downward continuation of the outer diameter of the top sub and an enlarged inner diameter, and a lower sub 13 threadedly connected to the lower end of the intermediate member and forming a further continuation thereof. As shown, the lower end of the lower sub has a contoured lower edge for facilitating lowering over the upper end of the fish into a fairly centralized location.

Figure 1B:
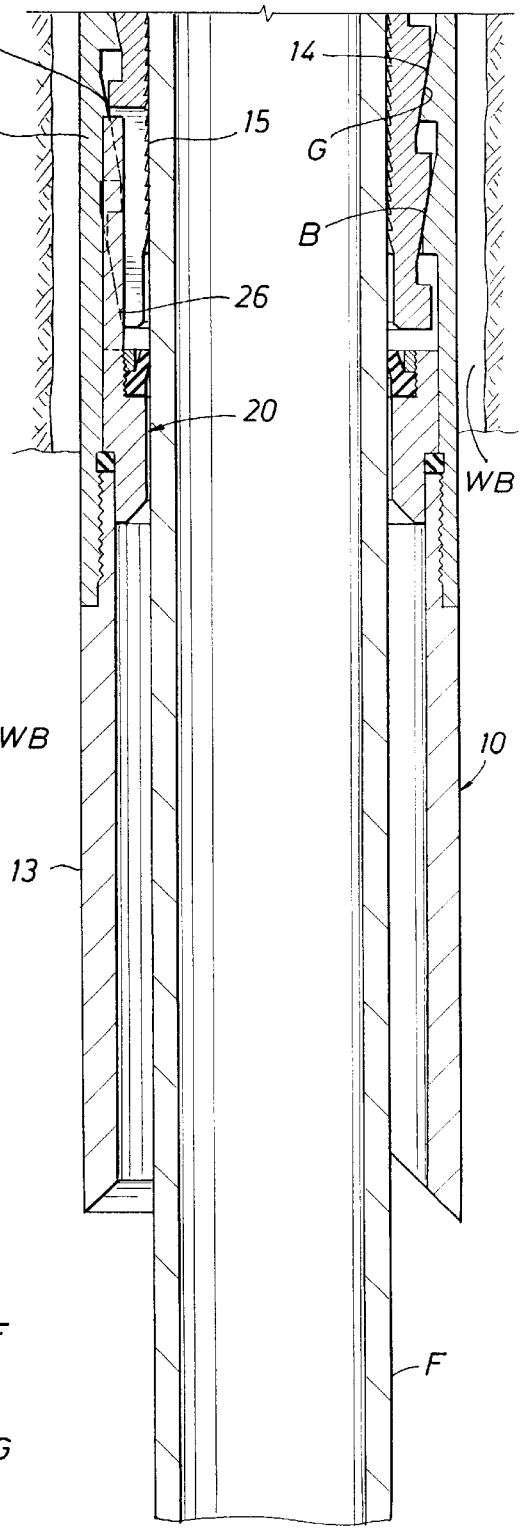

The lower end of the top sub is of an inner diameter somewhat less than the fish, so that it is prevented from further downward movement, as shown in FIG. 1A. The bore of the intermediate member provides a bowl B having a downwardly and inwardly helically formed surface. As previously described, a grapple G of a diameter to fit about the fish has similarly downwardly and helically formed surfaces for sliding along those of the bowl. The inner diameter of the grapple has vertically spaced, tapered teeth 15, or wickers thereabout so as to bite into the outer diameter of the fish as the grapple slides downwardly in the bowl, but to move out of tight gripping engagement with the fish when the grapple is raised withing the bow.

A packer assembly 20 is carried within the body of the tool beneath the grapple for sealing about the fish, and thus preventing fluid circulating downwardly through the overshot tool from flowing outwardly from the fish, rather than downwardly through it and upwardly with the annulus to remove debris particularly as the tool is being lowered about the overshot. As shown, the assembly includes a metal body 21 which is supported on a seat within the bore of the body beneath the lower end of the grapple. More particularly, the body 21 of the assembly is seated on a seal ring 23 supported on the upper end of the lower sub to seal between packer assembly body and the lower sub 21 and intermediate member of the body of the tool. The lower end of the body is flared for sliding over the upper end of the fish.

Slots 25 are formed in the lower ends of the intermediate member and grapple, so that, when aligned, they receive an upstanding tang 26 on the body 21 to limit relative rotation between them. With the pipe string and tool as a whole being rotatably in a right hand direction, both the helical threads of the bowl and wickers of right hand. Thus, as the grapple is lowered over the fish, and the tool rotated in the right hand direction, the lower end of the grapple is caused to be moved upwardly and thus be free to expand as its wickers slide down over the upper end of the fish. At this stage, the fish may be retrieved by lifting the pipe string to cause the grapple to be wedged inwardly by the helical surfaces of the bowl and thus grip the wickers. On the other hand, if the fish cannot be retrieved, the tool may be jarred downwardly by the pipe string to permit the grapple to expand and loosen the bite of the threads of the wicker teeth about the upper end of the fish, and thereby permitted to be raised from the well bore.

The improved packer assembly comprises, in the first embodiment of FIGS. 1–4, a metal body 21 having a bore 30 to pass freely over the fish and thus move downwardly thereover until the tool seats on the top of the fish and upstanding tang 26 on the body to fit closely within the aligned slots to limit relative movement between the grapple and tubular body of the tool. Upward movement of the end of the tang is limited by a downwardly facing shoulder 34 about the tubular member bore during the assembly of the tool. Finally, the lower sub may be threaded over the lower end of the intermediate member to connect them to one another and thus compress the outer seal ring 23 and, and the upper tubular member may be threadedly connected to the upper end of the intermediate member to complete assembly.

As shown in FIGS. 1A, 1B, 2 and 3, the upper end of the metal body of the packer assembly on which the tang is mounted is counterbored at 36 so as to permit a seal ring 37 of elastomeric material may be fitted closely over the counterbore to seat upon a lower end 38 thereof. As shown, the inner diameter of the seal ring has a lip 38 which is deformable to form a tight seal about the fish.

The outer diameter of the seal ring has a recess 39 thereabout to receive a metal retainer ring 40 for holding the seal ring tightly against the seat 38. Both the inner diameter 36 of the counterbore, and the outer diameter of the retainer rings are threaded at 40 so that the retainer ring may be moved downwardly to tightly engage and thus retain the seal ring. These threads are of left hand to prevent unthreading during operation of the tool.

In order to further facilitate retention of the seal ring and prevent its being blown out, the seat 38 is shown to have concentric grooves thereabout having sharp upper edges for biting into the lower end of the seal ring. This tight engagement is further enhanced by concentric rings 42 about the lower end of the retainer ring 40 (see FIG. 4) for biting into the lower end of the recess about the seal ring. In this embodiment of the invention, which is particularly well suited for relatively small diameter fish, the tang extends upwardly from the outer diameter of the metal body spaced outwardly of the retainer ring.

Figure 5:
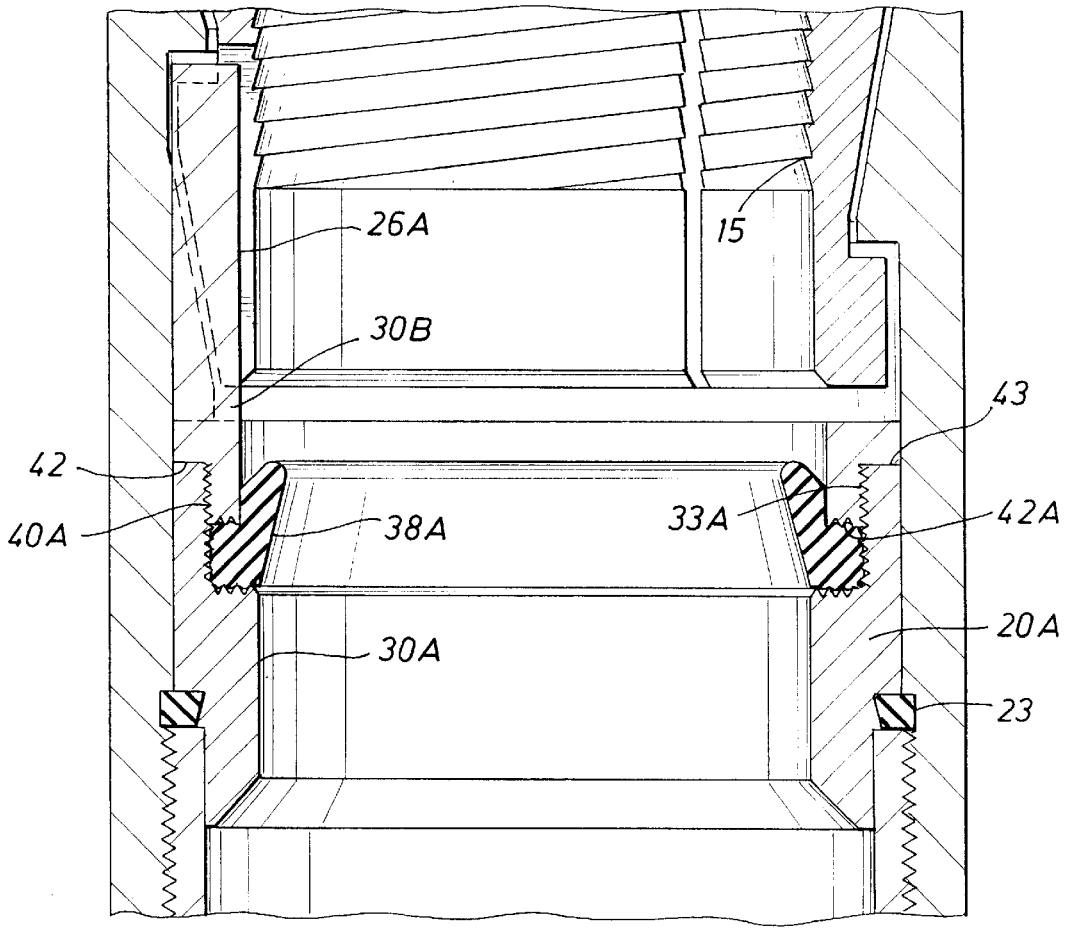
FIG. 5 is a vertical sectional view of a portion of the tool having a second embodiment of the packer assembly and invention.
Figure 6:
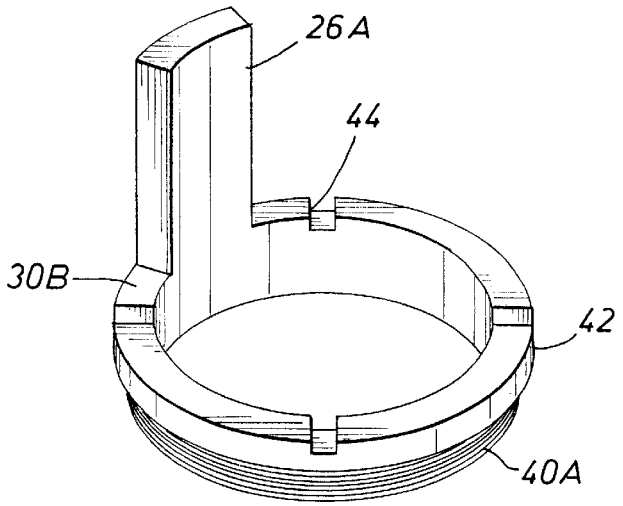
FIG. 6 is a perspective view of a of the retainer ring of the embodiment of the assembly of FIG. 5, including the upstanding tang.

In the alternative embodiment of the invention, which is shown in FIGS. 5 and 6, the bores of the grapple and metal body of the packer assembly 20A are larger to fit over a larger diameter fish. Otherwise, corresponding parts carry the same numbers as those of the first embodiment. Thus, the only other differences reside in the grapple assembly wherein the metal body is made up of two parts, the lower 30A of which is counterbored to form a seat 38A for the seal ring 23 and the upper 30B of which has an outer flange 42 for seating on the upper end 43 on the lower body portion 30A and a downward extension to provide a retainer ring 40A which as in the case of retainer ring 40 of the prior embodiment, is threaded to the recess 39A of the body of the assembly. In this embodiment, the tang 26A extends upwardly from the upper portion 30B of the seal body.

As shown, the lower end of the inward extension of the upper portion forming the retainer ring for fitting within the recess of the seat ring also has concentric rings 42A for biting into the seal ring. Similarly, the seat formed by the lower end of the counterbore of the metal ring has concentric rings for biting into the lower end of the seal ring about the bore of the seal body. As shown in FIG. 6, the upper end of the lower portion has parts 44 about its periphery to facilitate its being threaded into the recess of the lower portion. To prevent the possibility of loosening the retention of the seal ring in the second embodiment, the threads of the retainer ring and metal body of the seal assembly are of right hand.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. An overshot tool for use in recovering a fish within a well bore, comprising a tubular body having an upper end adapted to be connected to a pipe string for vertical movement within the well bore, a lower end adapted to fit over the fish when so lowered, a bowl within its bore having helically tapered surfaces, and a seat beneath the bowl, a radially expandable and contractible grapple within the bowl and having helically tapered outer surfaces adapted to slidably engage those of the bowl and helically tapered, vertically spaced threads about its inner side adapted to engage the fish, said bowl and body having aligned slots, a control packer assembly supported on the seat and having a tang for fitting within the slots so as to limit rotation between them, whereby as the tool body is raised and rotated to the right, the grapple surfaces slide downwardly along the bowl surfaces to cause the threads to tightly grip the fish so that it may be retrieved upon lifting of the pipe string or, in the event the fish cannot be retrieved, the tool body may be jarred downwardly to release the grip of the threads and thus permit the tool to be retrieved, said packer assembly including a metal body supported on the seat and having a counterbore about the upper end of its bore and threads about the counterbore, a ring of elastomeric material fitting closely within the counterbore of the packer body a lip about its bore to sealably engage about the fish, and an annular recess about the upper end of its outer diameter to provide a seat on its lower end, and a metal ring within the recess having threads thereabout to threadedly engage with the threads on the metal body to hold the elastomeric ring downwardly against the seat on the lower end of the recess.

2. As in claim 1, wherein:

the metal ring has an upper end which terminates beneath the upper end of the metal body when threadedly engaged with the metal body, and the tang is on the metal body.

3. As in claim 1, wherein:

the metal ring has an outwardly extending flange on its upper end adapted to overhang and engage the upper end of the metal body when the metal ring is threadedly engaged with the metal body, and the tang is on the metal ring.

4. As in claim 1 or 2, wherein:

the seat of the steal assembly body has concentric ribs for biting into the lower end of the elastomeric ring.

5. As in claim 1 or 2, wherein:

the lower end of the metal ring has concentric ribs on its lower end for biting into the seat of the recess of the elastomeric ring.

6. As in claim 1 or 2, wherein:

the lower end of the metal ring has concentric ribs on its lower end for biting into the seat of the recess of the elastomeric ring, and the seat of the slot assembly body has concentric ribs for biting into the lower end of the elastomeric ring.

7. For use with an overshot tool for recovering a fish within a well bore, wherein the tool comprises a tubular body having an upper end adapted to be connected to a pipe string for vertical movement within the well bore, a lower end adapted to fit over the fish when so lowered, a bowl within its bore having helically tapered surfaces, and a seat beneath the bowl, a radially expandable and contractible grapple within the bowl having helically tapered outer surfaces adapted to slidably engage those of the bowl and helically tapered, vertically spaced threads about its inner side adapted to engage the fish, said bowl and body having aligned slots:

a control packer assembly supported on the seat and having a tang for fitting within the slots so as to limit rotation between the bowl and body, whereby, as the tool body is raised and rotated to the right, the grapple surfaces slide downwardly along the bowl surfaces to cause the threads to tightly grip the fish so that it may be retrieved upon lifting of the pipe string or, in the event the fish cannot be retrieved, the tool body may be jarred downwardly to release the grip of the threads and thus permit the tool to be retrieved, the improvement in which said packer assembly includes a metal body adapted to be supported on the seat and having a counterbore about the upper end of its bore and threads about the counterbore, and a ring of elastomeric material adapted to fit closely within the counterbore of the packer body, a lip about its bore to sealably engage about the fish, and an annular recess about the upper end of its outer diameter to provide a seat on its lower end, and a metal ring within the recess having threads thereabout adapted to be threadedly engaged with the threads on the metal body to hold the elastomeric ring downwardly against the seat on the lower end of the recess.

8. As in claim 7, wherein:

the metal ring has an upper end which terminates beneath the upper end of the metal body, when threadedly engaged with the metal body.

9. As in claim 7, wherein:

the metal ring has an outwardly extending flange on its upper end adapted to overhand and engage the upper end of the metal body when the metal ring is threadedly engaged with the metal body, the outer diameter of the flange being essentially equal to that of the metal body.

10. As in claim 7 or 8, wherein:

the seal of the metal ring has concentric ribs for fitting the lower end of the elastomeric ring.

11. As in claim 7 or 8, wherein:

the lower end of the metal ring has concentric ribs on its lower end for biting into the seat of the recess about the elastomeric ring.

12. As in claim 7 or 8, wherein:

the lower end of the metal ring has concentric ribs on its lower end for biting into the seat of the recess about the elastomeric ring, and the metal ring has concentric ribs for fitting the lower end of the elastomeric ring.

* * * * *